US006030470A

United States Patent [19]

Hensger et al.

[11] Patent Number: 6,030,470

[45] Date of Patent: Feb. 29, 2000

[54] METHOD AND PLANT FOR ROLLING HOT-ROLLED WIDE STRIP IN A CSP PLANT

[75] Inventors: Karl-Ernst Hensger, Düsseldorf, Germany; Robert Davis, Wilmetle, Ill.

[73] Assignee: SMS Schloemann-Siemag Aktiengesellschaft, Düsseldorf, Germany

[21] Appl. No.: 09/095,338

[22] Filed: Jun. 10, 1998

[30] Foreign Application Priority Data

Jun. 16, 1997 [DE] Germany ..... 197 25 434.9

[51] Int. Cl.[7] ..... C21D 1/09

[52] U.S. Cl. ..... 148/541; 148/546; 148/602; 148/654

[58] Field of Search ..... 148/541, 546, 148/600, 598, 654, 661

[56] References Cited

FOREIGN PATENT DOCUMENTS

| | | | |
|---|---|---|---|
| 0368048 | 5/1990 | European Pat. Off. . | |
| 0413163 | 2/1991 | European Pat. Off. . | |
| 0595282 | 5/1994 | European Pat. Off. . | |
| 133322 | 6/1986 | Japan | 148/541 |
| 306004 | 7/1989 | Japan | 148/541 |
| 9641024 | 12/1996 | WIPO . | |

*Primary Examiner*—Deborah Yee
*Attorney, Agent, or Firm*—Friedrich Kueffner

[57] ABSTRACT

A method and a plant for rolling hot-rolled wide strip from continuously cast thin slabs of ferritic/pearlitic microalloyed structural steels with a microalloy with vanadium and/or with niobium and/or with titanium in a CSP plant or compact strip production plant, wherein the cast slab strand is supplied divided into rolling lengths through an equalizing furnace to a multiple-stand CSP rolling train and is continuously rolled in the CSP rolling train into hot-rolled wide strip, is then cooled in a cooling stretch and is reeled into coils. For achieving optimum mechanical properties in hot-rolled wide strip by thermomechanical rolling, a controlled structure development is carried out when the thin slabs travel through the CSP plant.

7 Claims, 1 Drawing Sheet

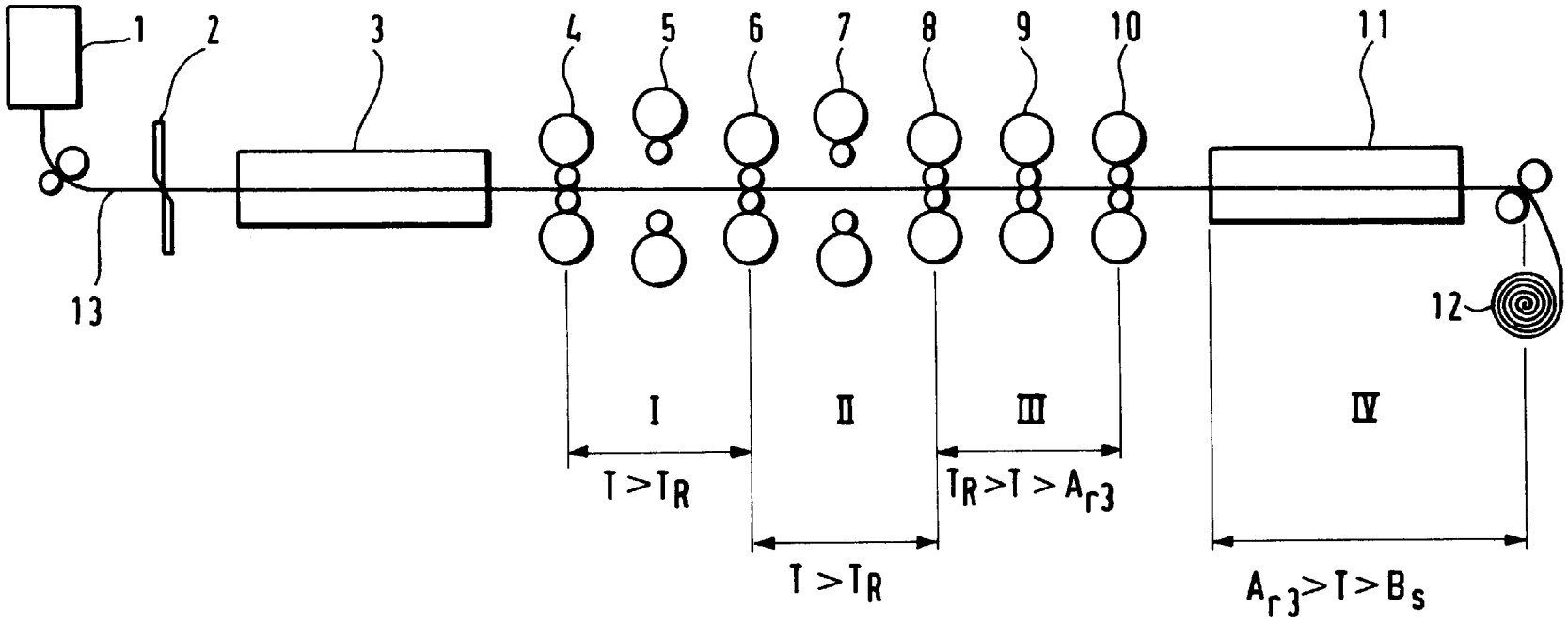
1
2
3
4
5
6
7
8
9
10
11
12
13
I
II
III
IV
T > T_R
T > T_R
T_R > T > A_r3
A_r3 > T > B_s

METHOD AND PLANT FOR ROLLING HOT-ROLLED WIDE STRIP IN A CSP PLANT

BACKGROUND OF THE INVENTION

1. Field of the Invention

The present invention relates to a method and a plant for rolling hot-rolled wide strip from continuously cast thin slabs of ferritic/pearlitic microalloyed structural steels with a microalloy with vanadium and/or with niobium and/or with titanium in a CSP plant or compact strip production plant, wherein the cast slab strand is supplied divided into rolling lengths through an equalizing furnace to a multiple-stand CSP rolling train and is continuously rolled in the CSP rolling train into hot-rolled wide strip, is then cooled in a cooling stretch and is reeled into coils.

2. Description of the Related Art

EP-A-0368048 discloses the rolling of hot-rolled wide strip in a CSP plant, wherein continuously cast initial material, after being divided into rolling lengths, is conveyed through an equalizing furnace directly to the rolling mill. Used as the rolling mill is a multiple-stand mill in which the rolled lengths which have been raised to a temperature of 1100° C. to 1130° C. in the equalizing furnace are finish-rolled in successive work steps, wherein descaling is carried out between the work steps.

In order to achieve an improvement of the strength and the toughness properties and the corresponding substantial increase of the yield strength and the notch value of a rolled product of steel, EP-A-0413163 proposes to thermomechanically treat the rolling stock.

In contrast to normalizing deformation in which the final deformation takes place in the range of the normal annealing temperature with complete recrystallization of the austenite, in the case of the thermomechanical deformation temperature ranges are maintained for a specified deformation rate in which the austenite does not recrystallize or does not significantly recrystallize, i.e., prior to the actual thermomechanical treatment of the rolling stock, an austenite structure is always present which does not contain any nuclei or structure components or only very small portions thereof in the phase which is stable at low temperature.

The adjustment of this initial structure can be effected either directly from the casting heat or in a preheating furnace from room temperature or an intermediate temperature.

In the method proposed in EP-A-0413163, the transformation of the rolling stock begins in the temperature range of the stable austenite and continues to just above the $A_{r3}$ temperature. In order to reach the most favorable temperature range for thermomechanical rolling, the initial pass temperature is determined in dependence on the desired degree of deformation.

A significant feature of the thermomechanical treatment is the utilization of the plastic deformation not only for manufacturing a defined product geometry, but also especially for adjusting a desired real structure and, thus, for ensuring defined material properties, wherein non-recrystallized austenite is subjected to the polymorphous gamma (γ)—alpha (α)—deformation (in the normalizing deformation the austentite is already recrystallized).

Prior to deformation in a conventional rolling mill, conventional slabs when used in the cold state are subjected to the polymorphous transformations:

melt (L)→ferrite (δ)→austentite $A_1$ (γ)→ ferrite (α)→austentite $A_2$ (γ)

while the following is true for the CSP technology:

melt (L)→ferrite (δ)→austentite $A_1$ (γ)

with an increased oversaturation of the mixed crystal austentite and an increased precipitation potential for carbonitrides from the austentite.

SUMMARY OF THE INVENTION

It is the primary object of the present invention to develop a specific method strategy for thermomechanical rolling in CSP plants in order to utilize in an optimum manner, when rolling CSP slabs in CSP plants, the peculiarities of the structure development and the resulting material properties by direct rolling without intermediate cooling and subsequent reheating.

In accordance with the present invention, for achieving optimum mechanical properties in hot-rolled wide strip by thermomechanical rolling, a controlled structure development is carried out when the thin slabs travel through the CSP plant, wherein the method includes the steps of a) changing the casting structure by adjusting defined temperature and shape changing conditions during the first deformation, wherein the temperature is above the recrystallization stop temperature $T_R$, so that during and/or after the first deformation a complete dynamic and/or meta-dynamic and/or static recrystallization of the casting structure takes place prior to the beginning of the second deformation step;

b) deforming in the last roll stands at temperatures below $T_R$ temperature, wherein the deformation should not fall below an amount of 30% and the final rolling temperature is near the $A_{r3}$ temperature (temperature of the austentite/ferrite transformation);

c) controlled cooling of the hot-rolled wide strip in the cooling stretch, preferably a laminar cooling stretch, wherein the polymorphous transformation of the austentite takes place at a temperature which is between the $A_{r3}$ temperature and the $B_s$ temperature (bainite starting temperature).

The measures according to the present invention adapt the thermomechanical deformation in an optimum manner to the specific method parameters of the CSP method with its specific thermal history.

When adjusting the temperature and the shape changing conditions, especially the following basic differences to conventional rolling should be taken into consideration:

in a conventional rolling mill, a slab with recrystallized structure which has been rough-rolled in the roughing train (plastically deformed) enters the finishing train;

in the CSP finishing train, the thin slab enters with cast structure;

the surface properties of a CSP thin slab differ substantially from a rough-rolled slab, for example, with respect to its topology.

These differences also result in differences in the solid body reactions triggered by the thermal deformation, for example:

by a different mobility of the high-angle grain boundaries;

different mixed crystal and precipitation behavior;

different diffusion mechanism and kinetics due to the different character of the boundary surfaces and the chemical inhomogeneities which also must be taken into consideration when adjusting the method parameters.

In accordance with the present invention, the first deformation is carried out at a temperature above the recrystallization stop temperature $T_r$, so that a complete recrystallization of the cast structure takes place during and/or after this first deformation. The recrystallization can take place dynamically and/or metadynamically and/or statically.

It is important in accordance with the present invention that this recrystallization is completely concluded before the next deformation is carried out. If the distance between the stands and the rolling speed are not sufficient for the time required, an advantageous further development of the present invention provides that the next roll stand is opened, so that sufficient time is available until the stand after the next stand is reached in which the second deformation is carried out. Opening of the roll stand does not exclude the possibility that the roll stand is used as a driver.

The further deformation in the last roll stands of the CSP rolling train then takes place at temperatures below the recrystallization stop temperature $T_r$ in order to solidify the austenite before its polymorphous transformation. The austenite solidifying transformation should not drop below a quantity of 30%. The final rolling temperature is close to the $A_{r3}$ temperature.

The polymorphous transformation of the austenite takes place subsequently during final cooling, for example, in a laminar cooling stretch, at a temperature which is between $A_{r3}$ (temperature of the austenite/ferrite transformation and the $B_s$ temperature (bainite start temperature).

A further improvement of the mechanical properties can be achieved by a further controlled cooling of the wound coil, wherein especially the precipitation processes are influenced in a specific manner.

In accordance with the present invention, the second deformation, which may only be carried out in a third roll stand, may serve preferably for starting a second recrystallization cycle which leads to a further refining and homogenizing of the structure before another deformation is carried out. For this purpose, the subsequent roll stand may also be opened, wherein this roll stand may also be used as required as a driver. During the second deformation, the temperature is also above the $T_R$ temperature.

A plant for carrying out the method according to the present invention includes a CSP plant in which the cast thin slabs are transformed directly in a multiple-stand CSP rolling train (without intermediate cooling and subsequent reheating), and in which a controlled structure development in the CSP rolling train, in the cooling stretch and in the reel is possible for achieving optimum mechanical properties of the hot-rolled wide strip, wherein a variable time span is adjustable as required for a complete recrystallization between the first and the second deformation and, if necessary, also between the second and the third deformation.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawings is a schematic view of an embodiment of the plant according to the present invention for carrying out the method of the invention.

DESCRIPTION OF THE PREFERRED EMBODIMENTS

The drawing shows a CSP plant in which a hot-rolled wide strip having a thickness of about 6 mm of high-strength structural steel is manufactured by thermomechanical rolling.

The thin slabs 13 emerging from the continuous casting plant 1 are divided into rolling lengths by means of a cutting unit 2 and are introduced into an equalizing furnace 3 in which the temperature of the slabs is adjusted to about 1130° C.

The first deformation is carried out with a pass reduction of 50% in the first roll stand 4 at a deformation temperature of 1080° C. In order to ensure that the desired recrystallization is completed before the second deformation, the second roll stand 5 is open and merely serves as a driver.

The second deformation is then carried out in the third roll stand 6 with a pass reduction of 40% at a deformation temperature of 1030° C. Since this transformation is utilized for a further recrystallization, the subsequent fourth roll stand 7 is also open and only serves as a driver.

The further deformation stages are:

- a third deformation in the fifth roll stand 8 with a pass reduction of 30% at a deformation temperature of 900° C.;
- a fourth deformation in the sixth roll stand 9 with a pass reduction of 25% at a deformation temperature of 840° C.; and
- a fifth deformation in the seventh roll stand 10 with a pass reduction of 15% at a deformation temperature of 800° C.

Subsequently, the hot-rolled wide strip is cooled in a laminar cooling stretch 11 to 600° C. (coiling temperature) and is reeled into a coil in a below-ground reeling unit 12.

The drawing shows the temperature ranges corresponding to the individual method steps. The time period I between the first and the second deformation serves as a first recrystallization phase, wherein the temperature T is greater than the $T_R$ temperature.

The time period II between the second deformation and the third deformation serves as a second recrystallization phase, wherein the temperature T is also greater than the $T_R$ temperature.

The time period III from third deformation to the last deformation serves for the solidification of the austenite with a temperature T between the $T_R$ and the $A_{r3}$ temperature.

The time period IV after the last deformation during which cooling is carried out serves for the polymorphous transformation of the austenite. The temperature T is in this step between the $A_{r3}$ temperature and the $B_s$ temperature.

The parameters mentioned in connection with the example described above merely represent possible parameters for a certain type of steel, wherein other parameters, such as roll diameter, rolling speed, distances between the roll stands, are also to be taken into consideration in order to achieve an optimum influence on the structure by the thermomechanical transformation.

While specific embodiments of the invention have been shown and described in detail to illustrate the inventive principles, it will be understood that the invention may be embodied otherwise without departing from such principles.

We claim:

1. In a method of rolling hot-rolled wide strip from continuously cast thin slabs of ferritic/pearlitic microalloyed structural steels with a microalloy with at least one of vanadium and niobium and titanium in a CSP plant, wherein a cast slab strand is divided into rolling lengths and is supplied through an equalizing furnace to a multiple-stand CSP rolling train and is continuously rolled in the CSP rolling train into hot-rolled wide strip, is cooled in a cooling stretch and is reeled into coils, the improvement comprising, for achieving optimum mechanical properties in hot-rolled wide strip by thermomechanical rolling, carrying out a controlled structure development as the thin slabs travel through the CSP plant, the method comprising the steps of:

(a) changing the cast structure by adjusting defined temperature and shape changing conditions during a first transformation, wherein the temperature is above the recrystallization stop temperature, so that a complete recrystallization of the cast structure takes place at least one of during and after the first deformation and prior to a beginning of a second deformation step;

(b) carrying out a deformation in the last roll stands at temperatures below the recrystallization stop temperature, wherein the deformation is not to drop below a quantity of 30% and a final rolling temperature is near the austenite/ferrite transformation temperature; and (c) carrying out a controlled cooling of the hot-rolled strips in the cooling stretch, wherein the polymorphous transformation of the austenite takes place at a temperature between the austenite/ferrite transformation temperature and the bainite start temperature.

2. The method according to claim 1, comprising carrying out cooling in a laminar cooling stretch.

3. The method according to claim 1, comprising opening a second roll stand as required for making available sufficient time for the recrystallization of the first transformation.

4. The method according to claim 1, comprising starting a second recrystallization cycle by a second deformation after the recrystallization of the cast structure due to the first deformation.

5. The method according to claim 4, comprising opening a subsequent roll stand for making available further time required for the recrystallization by the second deformation step and utilizing the subsequent roll stand as necessary only as a driver.

6. A plant for rolling hot-rolled wide strip from continuously cast thin slabs of ferritic/pearlitic microalloyed structural steels with a microalloy with at least one of vanadium and niobium and titanium in a CSP plant, wherein a cast slab strand is divided into rolling lengths and is supplied through an equalizing furnace to a multiple-stand CSP rolling train and is continuously rolled in the CSP rolling train into hot-rolled wide strip, is cooled in a cooling stretch and is reeled into coils, wherein the multiple-stand rolling train comprises at least a first and a second deforming stand, wherein the multiple-stand rolling train is configured such that defined shape changing conditions of the first deforming stand are adjustable such that a recrystallization of the cast structure of the thin slab takes place at least one of during and immediately following the first deformation, and wherein a sufficiently great distance exists between the first deforming stand and the second deforming stand, so that, depending on the recrystallization time, the recrystallization is concluded when the second deformation begins.

7. The plant according to claim 6, wherein the rolling train includes a third deforming stand, wherein a distance between the second deforming stand and the third deforming stand corresponds at least to a duration of another recrystallization which is started at the second deformation and is essentially concluded at the beginning of the third deformation.

* * * * *